US009375106B2

(12) United States Patent
Ash et al.

(10) Patent No.: US 9,375,106 B2
(45) Date of Patent: Jun. 28, 2016

(54) BOWL/MUG SYSTEM WITH A FIGURINE FOR PLAYING WITH FOOD

(71) Applicant: Max'is Creations, Inc., Boston, MA (US)

(72) Inventors: Max J Ash, Weston, MA (US); Jennifer B Ash, Weston, MA (US); Ronald A Ash, Weston, MA (US); Jordan Nollman, Boston, MA (US)

(73) Assignee: HMDYH Holding Company, LLC, Norwood, MA (US)

( * ) Notice: Subject to any disclaimer, the term of this patent is extended or adjusted under 35 U.S.C. 154(b) by 0 days.

(21) Appl. No.: 14/624,963

(22) Filed: Feb. 18, 2015

(65) Prior Publication Data

US 2015/0157150 A1 Jun. 11, 2015

Related U.S. Application Data

(63) Continuation-in-part of application No. 29/475,295, filed on Dec. 2, 2013, now Pat. No. Des. 723,336.

(60) Provisional application No. 61/941,187, filed on Feb. 18, 2014.

(51) Int. Cl.

| | |
|---|---|
| ***A47G 19/22*** | (2006.01) |
| ***A63F 7/06*** | (2006.01) |
| ***B65D 81/36*** | (2006.01) |

(Continued)

(52) U.S. Cl.

CPC ..... *A47G 19/2227* (2013.01); *A47G 23/0306* (2013.01); *A63F 7/0608* (2013.01); *A63F 7/0612* (2013.01); *A63F 7/0616* (2013.01); *A63F 7/0632* (2013.01); *A63F 7/0668* (2013.01); *B65D 81/365* (2013.01); *A63F 2009/0012* (2013.01); *A63F 2009/0053* (2013.01); *A63F 2009/0058* (2013.01)

(58) Field of Classification Search

CPC ..... A43F 2009/0053; A43F 2009/0012; A43F 2009/0049; A43F 2209/0058; A47G 19/2227; A47G 19/025; A47G 21/182; A47G 23/0306; A63F 7/06–7/0656; A63F 7/0668; A63F 7/20; B65D 81/365

USPC ..... D7/514–517, 159, 520, 539, 301

See application file for complete search history.

(56) References Cited

U.S. PATENT DOCUMENTS 1,793,969 A * 2/1931 Simmons ..... A63F 7/0608 273/317.9

2,362,188 A * 11/1944 Clark ..... A63F 7/0608 273/127 R (Continued)

OTHER PUBLICATIONS http:/tweb.archive.orgtweb/20130613105718/http:I/m axiscreations.com/.*

*Primary Examiner* — Anthony Stashick
*Assistant Examiner* — Mollie Llewellyn
(74) *Attorney, Agent, or Firm* — Ascentage Patent Law, LLC; Travis Lee Johnson; David S. Einfeldt

(57) ABSTRACT

A bowl or mug system has various extensions from the handle or rim portions that are indicative of parts of various sports games, such as soccer and hockey nets, field-goal posts, and other extensions containing openings, holes, or back stops that are connected to the rim or handle of a mug and extend over the open container portion of the mug or bowl. Embodiments also contain launching platforms formed opposite from the sports equipment.

11 Claims, 16 Drawing Sheets

(51) Int. Cl.
*A47G 23/03* (2006.01)
*A63F 9/00* (2006.01)

(56) References Cited

U.S. PATENT DOCUMENTS

D308,431 S * 6/1990 Phelps ..... D21/703
D330,826 S * 11/1992 English ..... D7/515
D333,373 S * 2/1993 Pacelli ..... D99/37
5,290,040 A * 3/1994 Boroski ..... A63B 67/06
273/348.4
D370,154 S * 5/1996 Gruneisen, III ..... D7/301
5,762,569 A * 6/1998 Hale ..... A63B 24/0021
273/400
D474,372 S * 5/2003 Leon ..... D7/301
D529,250 S * 9/2006 Sofy ..... D34/4
7,472,801 B1 * 1/2009 Moynihan ..... B65F 1/14
220/694
7,611,146 B2 * 11/2009 Arden ..... A63B 67/083
273/317
7,722,049 B2 * 5/2010 Williams ..... A47G 19/025
273/317
2006/0086742 A1 * 4/2006 Napientek ..... A47G 19/025
220/574

* cited by examiner

BOWL/MUG SYSTEM WITH A FIGURINE FOR PLAYING WITH FOOD

CROSS-REFERENCE TO RELATED APPLICATIONS

This application is a continuation-in-part of U.S. patent application Ser. No. 29/475,295 filed on Dec. 2, 2013 and claims the benefit of U.S. Patent Application 61/941,187 filed on Feb. 18, 2014, both of which are incorporated herein by reference.

COPYRIGHT STATEMENT

A portion of the disclosure of this patent application document contains material that is subject to copyright protection including the drawings. The copyright owner has no objection to the facsimile reproduction by anyone of the patent document or the patent disclosure as it appears in the Patent and Trademark Office file or records, but otherwise reserves all copyright rights whatsoever.

FIELD OF THE INVENTION

The present invention relates to a vessel such as bowls and mugs and more particularly to bowls and mugs for enhancing playing with food.

BACKGROUND OF THE INVENTION

Presently, bowls and mugs exist to contain a beverage or food therein. A number of mugs and bowls exist that have various shapes, forms, or pictures present thereon. There are few mugs or bowls that exist to incite mimicking sports play with food.

SUMMARY OF THE INVENTION

It is recognized that there is a need for a food or drink vessel such as a bowl or mug system to induce or inspire sports play and fun interaction with food and beverages. The system described herein provides a platform for engaging and interacting with food and beverage in a manner that mimics a particular sport or sports' play.

In one embodiment, a mug comprising an open container portion and handle portion has a protruding sports equipment item (such as a baseball glove, basketball net, field goal post, soccer or hockey goal/net, baseball outfield wall, etc) extending from one edge of the container. On an opposite edge of the container a delivery platform is formed (such as golf tee mount, baseball tee, football tee, flat platform, etc.). The delivery platform is configured to hold an item of food to be propelled or launched toward the opposite side of the container where the protruding sports equipment resides.

In some variations of the above embodiment, the sports equipment item resides on the same side as a handle, thus forming a mug.

In an embodiment, a vessel includes a container configured to hold a beverage having an open end and having a lip portion. A figurine projects upward from the lip.

In an embodiment, the figurine forms a target and is positioned over the open end of the container. In an embodiment, the vessel has an extension indicative of a sporting equipment extending from the lip that forms a target and is positioned over the open end of the container. The figurine is located on a platform formed of the lip opposite the sporting equipment adapted to move a food product towards the sporting equipment.

In an embodiment, the figurine has a return mechanism for rotating the figurine from a cocked position to launch position. In an embodiment, the return mechanism has a shaft extending from the figurine and a spring for biasing the figurine towards the launch position.

In an embodiment, a vessel including a container configured to hold a beverage has an open end and has a lip portion having an extension indicative of sporting equipment extending from the lip that forms a target and is positioned over the open end of the container.

In an embodiment, the vessel has a handle portion extending from a sidewall of the container defining a mug. In an embodiment, the extension indicative of sporting equipment extends from the handle portion.

In an embodiment, the vessel includes a platform formed opposite of the sporting equipment. In an embodiment, the platform has an incline. In an embodiment, the platform has a recess adapted to receive a food product.

In an embodiment, the lip portion of the vessel is in the cross-sectional shape of a piece of sports equipment. In an embodiment, the cross-sectional shape is a football. In an embodiment, the cross-sectional shape is circular.

In an embodiment, the extension indicative of a sporting equipment is from the group of a baseball glove; an outfield wall; a football goal post; a basketball basket; a soccer goal; and a hockey net.

In an embodiment, the vessel is a bowl.

In an embodiment, the figurine and the extension indicative of a sporting equipment are from the group of pairs of a baseball player with a bat and baseball glove; a baseball player with a bat and an outfield wall; a football player with a kicking foot and a football goal post; a soccer player with a kicking foot and a soccer goal; and a hockey player with a stick and a hockey net.

In an embodiment of a play system, the system has at least one vessel and a placemat for receiving the one vessel. The vessel has a container configured to hold a beverage having an open end and having a lip. An extension indicative of a sporting equipment extends from the lip that forms a target and is positioned over the open end of the container. A figurine projects upward from the lip on a platform of the lip opposite the sporting equipment adapted to move a food product towards the sporting equipment.

In an embodiment of a play system, the system includes at least one vessel and a placemat for receiving the one vessel. The vessel includes a container configured to hold a beverage and has an open end and a lip. The vessel has an extension indicative of sporting equipment extending from the lip that forms a target and is positioned over the open end of the container.

In one embodiment a mug comprising an open container portion and handle portion has a protruding sports equipment item (such as a baseball glove, basketball net, field goal post, soccer or hockey goal/net, baseball outfield wall, etc) extending from one edge of the container. On an opposite edge of the container a delivery platform is formed (such as golf tee mount, baseball tee, football tee, flat platform, etc.). The delivery platform is configured to hold an item of food to be propelled or launched toward the opposite side of the container where the protruding sports equipment resides.

In some variations of the above embodiment, the sports equipment item resides on the same side as a handle, thus forming a mug.

In another embodiment, a sports figurine or athlete is mounted on or near the delivery platform. This figurine in some variations may be rotatable. In other variations the figurine may have a return mechanism that causes the figurine to rotate back to its original position after being rotated by a user. This helps to mimic a swinging or kicking motion of a baseball figurine, soccer figurine, hockey figurine, and so forth. During the return motion the figurine may then propel the food item on the delivery platform towards the opposite side where the sports equipment item is located.

It is also contemplated to have multiple rotating axis about which the figurine could be actuated. For example, the figure could rotate along the yaw, roll, and pitch axis.

It is to be understood that the features of the various embodiments described herein are not mutually exclusive and may exist in various combinations and permutations.

BRIEF DESCRIPTION OF THE DRAWINGS

The foregoing and other objects, features, and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE PREFERRED EMBODIMENT

Imaginative persons have been known to mentally transform ordinary objects such as trash cans into baskets for play as if they were throwing a real basketball into a basketball hoop. Mugs and bowls have this natural shape and opening into which anything in a person's hand may be thrown. For example, marshmallows may be such an object thrown into a mug containing hot chocolate. The play and interaction between the items mentioned (mug, hot chocolate, and marshmallows) provide entertainment and even creative opportunities that may be positive for mental health.

Described herein are several embodiments of containers or vessels, mugs, and bowls with extensions that are indicative of various types of sports equipment including field goal posts, goalie nets, hockey nets, basketball backboard and net, baseball gloves, outfield or back field wall, and so forth that help facilitate such play and creativity when a person is interacting with their food and beverage (or any other object or liquid) that may be placed in such vessels. In addition to indicative of various types of sports equipment, the vessels can include sports figurines including baseball player, soccer player, hockey player, and football player.

Figure 1B:
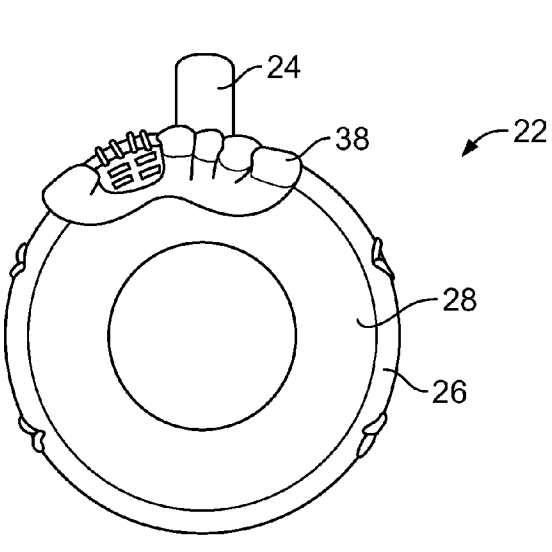
FIG. 1B is a top view of the mug of FIG. 1A.
Figure 1A:
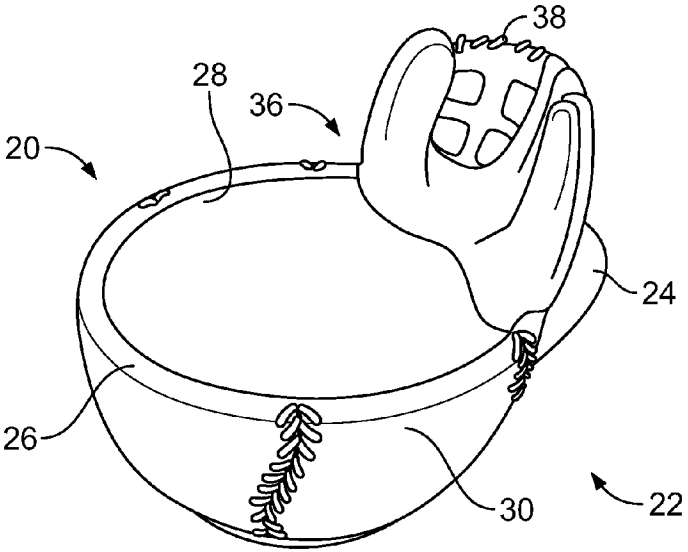
FIG. 1A is a perspective view of a mug having a baseball glove extending from the lip of the mug near the handle.

Referring to FIG. 1A, a perspective view of a vessel 20 is shown. The vessel 20 is a container which is a mug 22. A mug 22 is generally considered a drinking cup having a handle 24 and often made of a heavy substance such as earthenware, as seen in FIG. 1A. However, as shown in the various embodiments, the mugs 22 are not limited to a cylindrical shape. The mug 22 has a lip or rim 26 between an interior surface 28 and the exterior surface 30. The mug 22 has an extension indicative 36, which in this embodiment is a baseball glove 38, which is formed integral with the mug 22 and extends upward from the lip 26 of the mug 22 near the handle 24.

Referring to FIG. 1B, a top view of the mug 22 is shown. The extension indicative 36, the baseball glove 38, extends upward, out of the page in the FIG, from the lip 26. The baseball glove 38 is located near the handle 24.

Figure 1D:
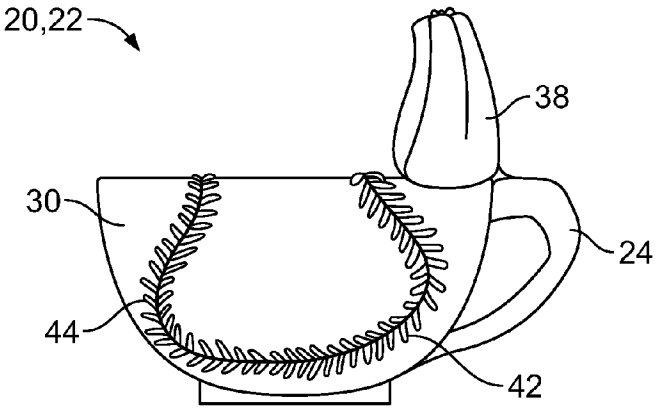
FIG. 1D is a side view of the mug of FIG. 1A.
Figure 1C:
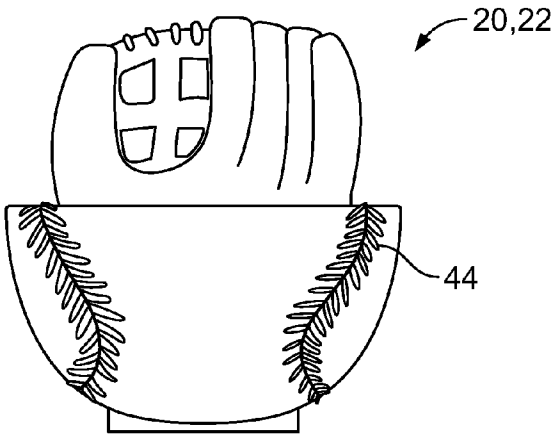
FIG. 1C is a front view of the mug of FIG. 1A.

Referring to FIG. 1C, a front view of the mug 22 of FIG. 1A is shown. A side view of the mug of FIG. 1A is shown in FIG. 1D. In addition to the baseball glove 38 extending upward, the mug has a design 42 which in this embodiment is a stitch pattern 44 formed on the exterior surface 30.

Figure 1E:
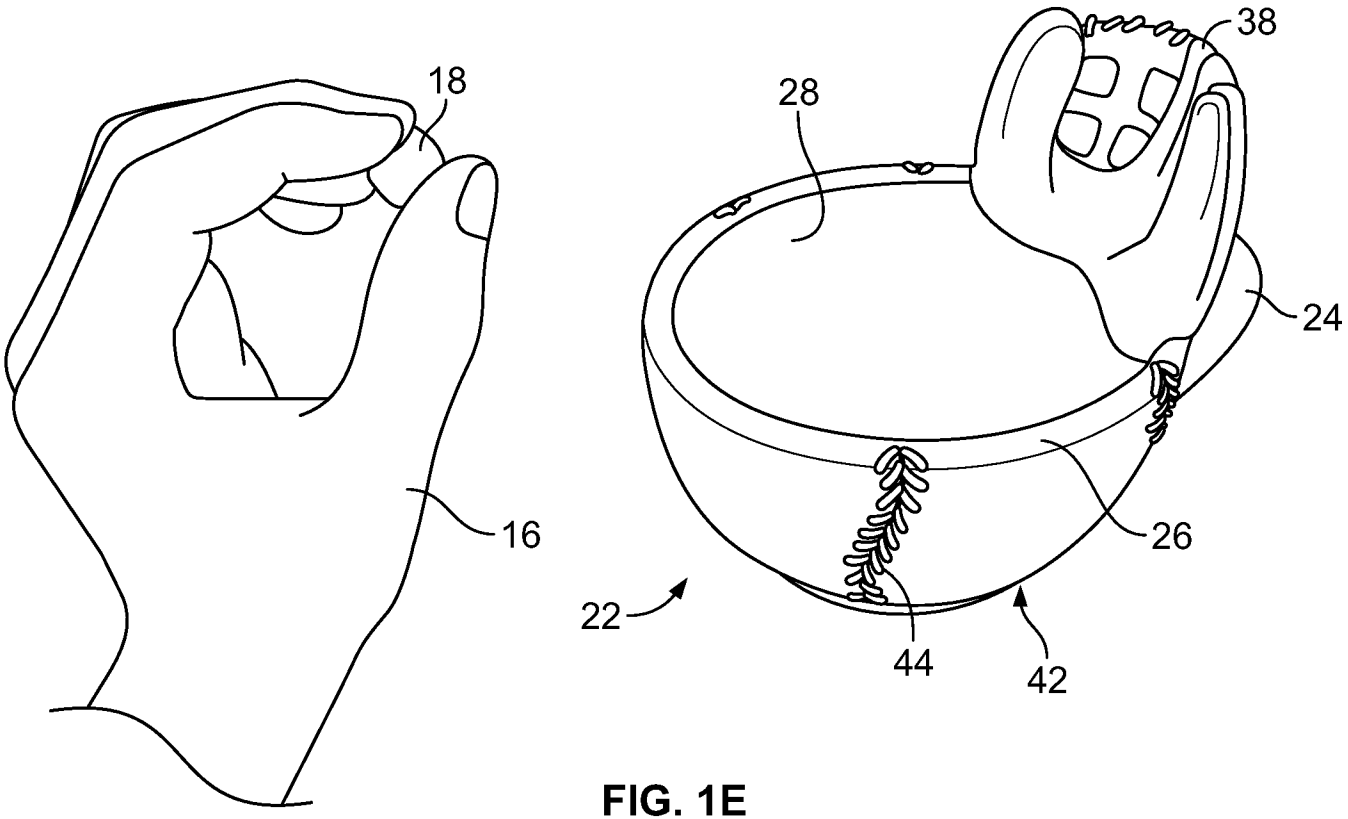
FIG. 1E is a perspective view of the user pitching a food product into the mug of FIG. 1A.

Referring to FIG. 1E, a perspective view of a user 16 pitching a food product 18 into the mug of FIG. 1A is shown. The baseball glove 38 extends from the lip 26 of mug 22 in proximity to the handle 24. The user 16 may, as illustrated, throw marshmallows, a food product 18, into the extending glove 38. The marshmallows, the food product 18, drop into the interior of the mug 22 which could contain hot chocolate. The design 42 of the stitch pattern 44 formed on the exterior surface 30 is shown.

The glove 38 may be formed out of plastic, ceramic, metal, glass, and other known materials to create mugs 22 and containers. While in the embodiment shown, the glove 38 and the mug 22 are formed integral to and of the same material, it is recognized that the extension indicative 36, the glove 38 in this embodiment, could be formed of a different material from the vessel 20, the mug 22. In the embodiments shown here the lip, rim or edge 26 of the mug 22 has a consistent shape and thickness.

Figure 2B:
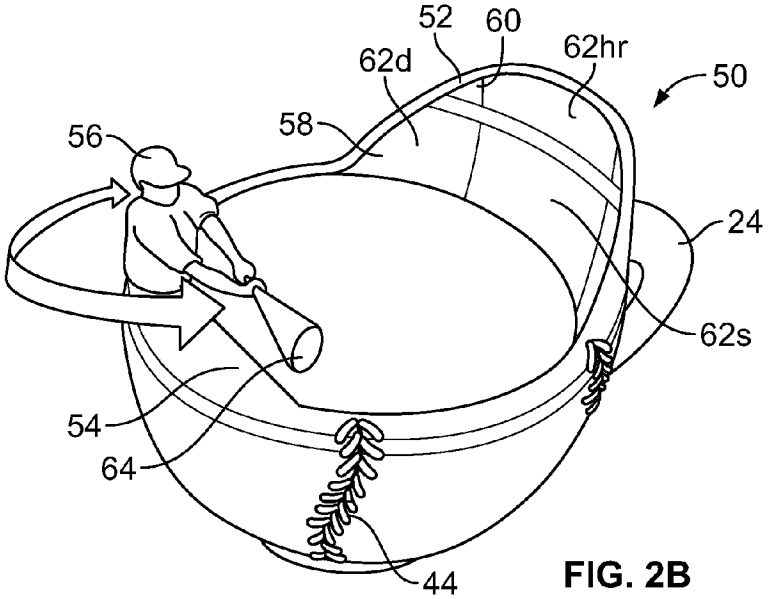
FIG. 2B is a perspective view of the mug of FIG. 2A.
Figure 2D:
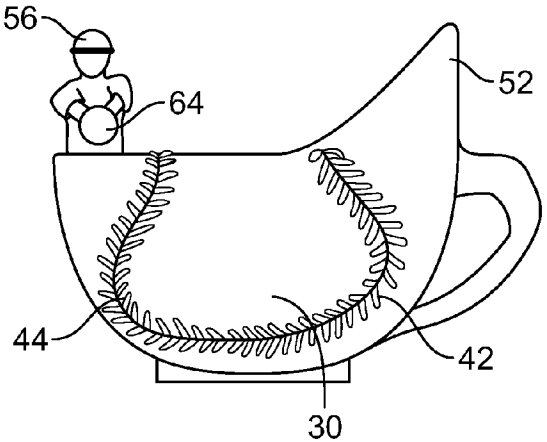
FIG. 2D is a side view of the mug of FIG. 2A.
Figure 2A:
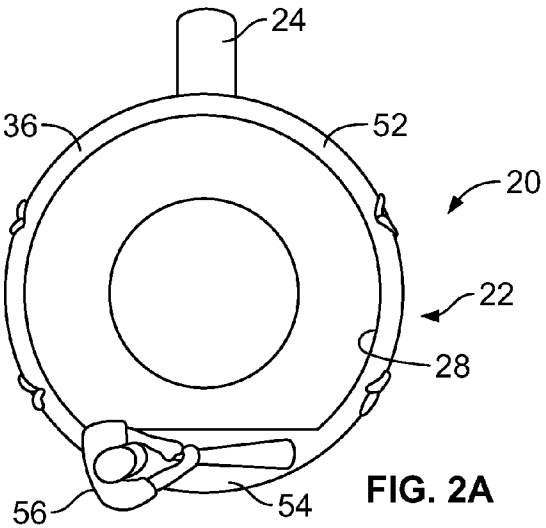
FIG. 2A is a top view of a mug having a baseball outfield wall extending from the lip of the mug near the handle and a platform with a baseball figurine on the opposite side from the handle.

Referring to FIG. 2A, a top view of an alternative vessel 20, a mug 50 is shown. The mug 50 has an extension indicative 36 which in this embodiment is a baseball outfield wall 52, as best seen in FIG. 2B, extending from the lip 26 of the mug 50 near the handle 24. The mug 50 has a platform 54 which is a larger area of the lip or rim 26 on the side opposite the handle 24. The mug 50 has a baseball figurine 56 on the platform 54.

Referring to FIG. 2B, a perspective view of the mug 50 of FIG. 2A is shown. The baseball outfield wall 52 has a series of marks 58 showing various areas including lines 60 and categories 62, such as single 62*s*; double 62*d*; triple 62*t*; and home run 62*hr*. The baseball figurine 56 has a bat 64. The baseball figurine 56 can be rotated clockwise toward a cocked position and a food product 18 can be placed on the platform 54. The figurine 56 rotates counter-clockwise towards a launch position resulting in the bat engaging the food product 18 and directing the food product towards the baseball outfield wall 52 which projects upward from the lip 26 of the mug 50.

Figure 2C:
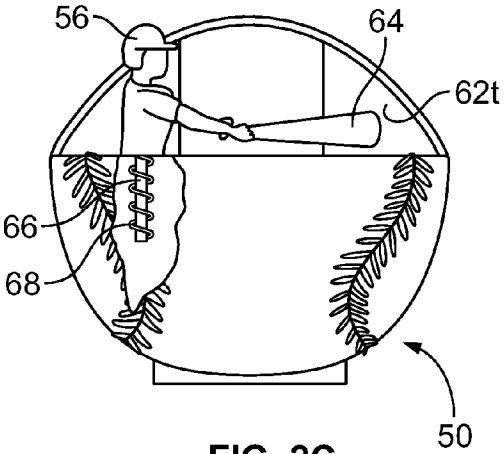
FIG. 2C is a front view of the mug of FIG. 2A.

Referring to FIG. 2C, a front view of the mug 50 of FIG. 2A is shown. A side view of the mug 50 of FIG. 2A is shown in FIG. 2D. In addition to the baseball outfield wall 52 extending upward, the mug 50 has a design 42 which in this embodiment is a stitch pattern 44 formed on the exterior surface 30. A portion of the mug 50 is broken away to show a shaft 66 in FIG. 2C that extends from the baseball figurine 56. In an embodiment, the vessel 20 has a spring 68 that returns or swings the figurine 56 back once rotated. This allows the bat 64 of the figurine 56 to swing and hit an item, food product 18, off the platform 54 towards the outfield wall 52 that extends upwards from the mug 22 on the opposite side.

Figure 3B:
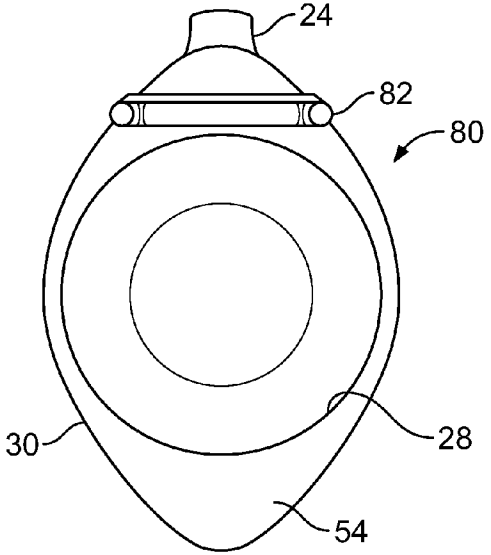
FIG. 3B is a top view of the mug of FIG. 3A.
Figure 3D:
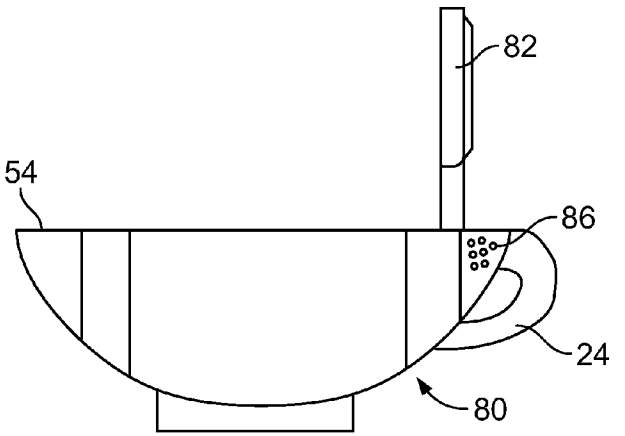
FIG. 3D is a side view of the mug of FIG. 3A.
Figure 3A:
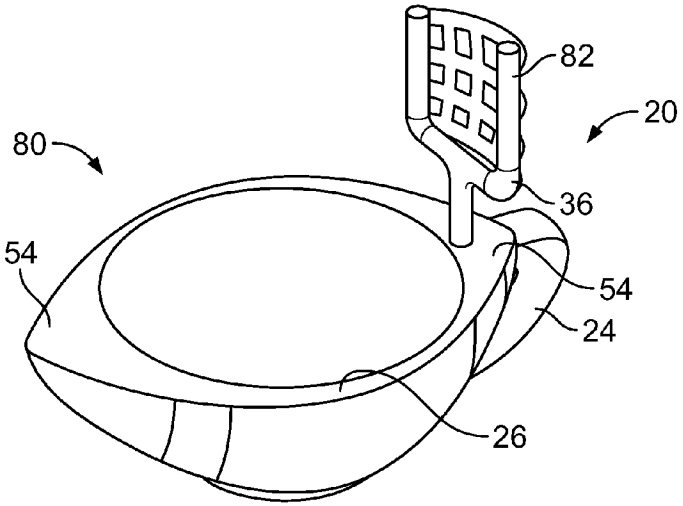
FIG. 3A is a perspective view of a mug having a cross-section of a football at the lip and a football field goal post extending from the lip of the mug near the handle.

Referring to FIG. 3A, a perspective of an alternative mug 80 having a cross-section of a football at a lip 26 is shown. The extension indicative 36 in this embodiment is a football field goal post 82 extending from the lip 26 of the mug 80 near the handle 24. A football generally has a prolate spheroid shape; an elliptical shape. The elliptical shape provides a platform 54 on two opposite ends of the football shaped mug 80 with the football field goal post 82 extending from one platform 54, the platform adjacent to the handle 24.

Referring to FIG. 3B, a top view of the mug 80 of FIG. 3A is shown. The platform 54 is flat and has generally a triangular shape defined by the curved interior surface 28 of the mug 80 and the surface of the prolate spheroid, the exterior surface 30 of the mug 80. The handle 24 and the platform 54 are generally located at the end of the major axis of the prolate spheroid shape.

Figure 3C:
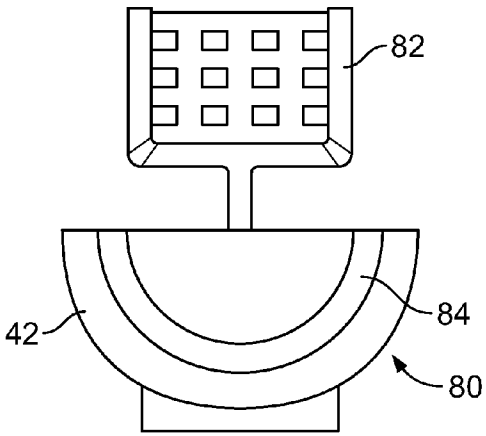
FIG. 3C is a front view of the mug of FIG. 3A.

Referring to FIG. 3C, a front view of the mug 80 of FIG. 3A is shown. A side view of the mug 80 of FIG. 3A is shown in FIG. 3D. In addition to the football field goal post 82 extending upward, the mug 80 has a design 42 which in this embodiment is a pair of stripes 84 and a plurality of dimples 86 formed on the exterior surface 30. The design 42 can be modified based on the desire of the designer. For example, the mug 80 may not include dimples.

Figure 3E:
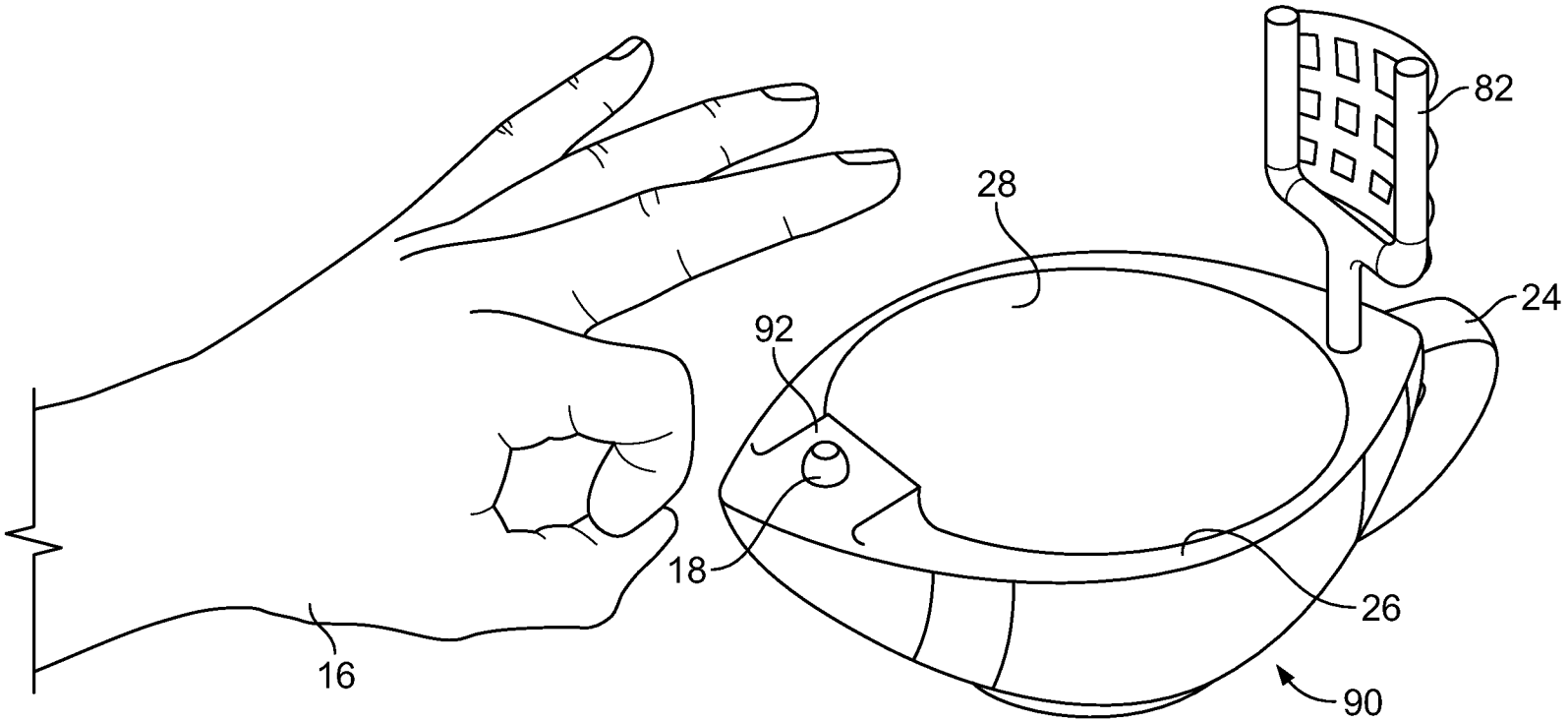
FIG. 3E is a perspective view of a mug similar to that of FIG. 3A with an inclined platform at the opposite end, apex, from the football field goal.
Figure 4B:
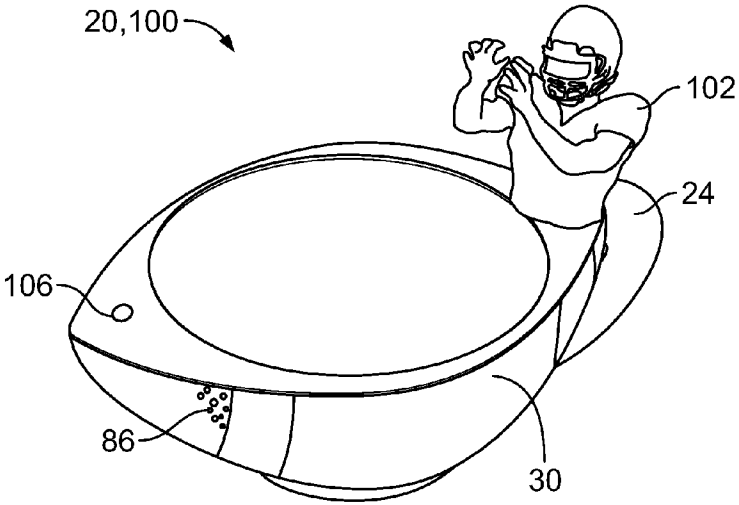
FIG. 4B is a perspective view of the mug of FIG. 4A.
Figure 4D:
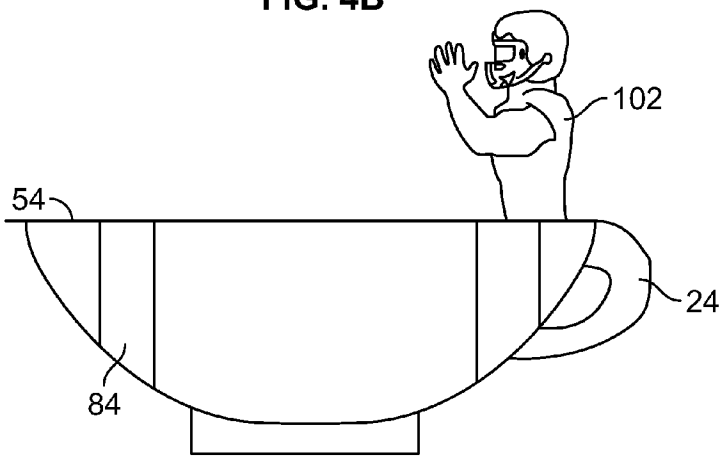
FIG. 4D is a side view of the mug of FIG. 4A.
Figure 4A:
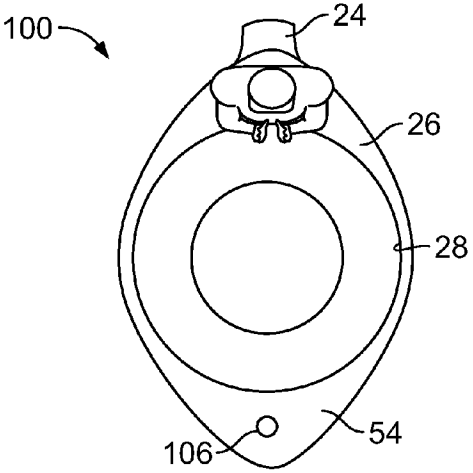
FIG. 4A is a top view of an alternative embodiment of a mug having a football figurine extending from the end of the mug having a handle and a platform on the opposite end that in part forms the cross-section of a football.
Figure 4C:
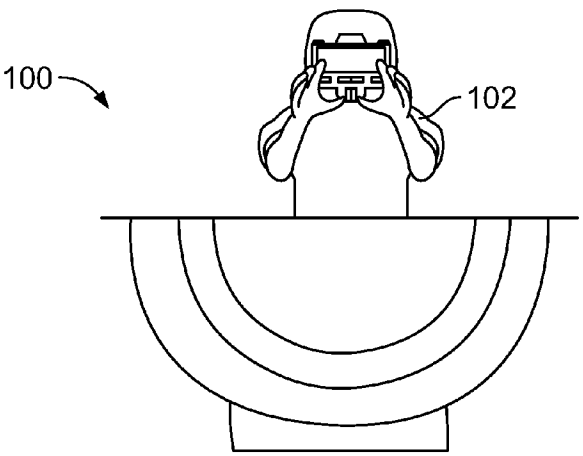
FIG. 4C is a front view of the mug of FIG. 4A.

Referring to FIG. 3E, a perspective view of a mug 90 similar to that of FIG. 3A with a platform 92 which is inclined at the opposite end (apex) from the football field goal post 82 is shown. The inclined platform 92 allows a user 16 to flick a food product 18, such as mini-marshmallows, upwards toward the field goal post 82 that also includes netting for catching the flicked items.

Figure 5B:
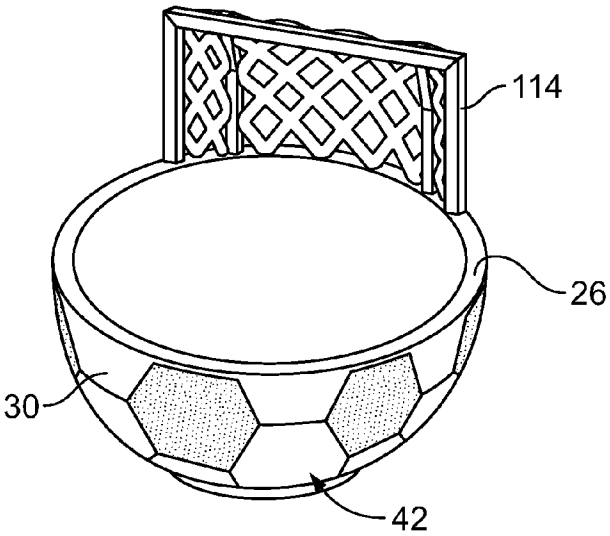
FIG. 5B is a perspective view of the bowl of FIG. 5A.
Figure 5D:
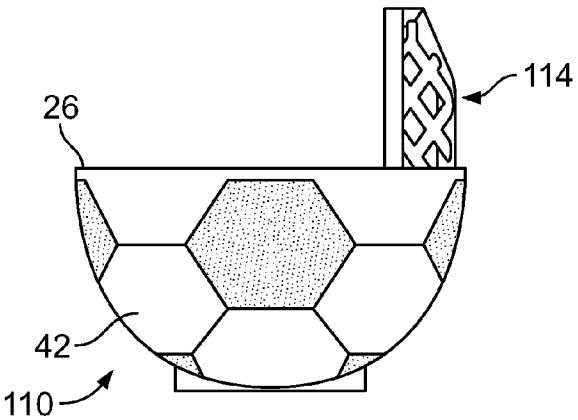
FIG. 5D is a side view of the bowl of FIG. 5A.
Figure 5A:
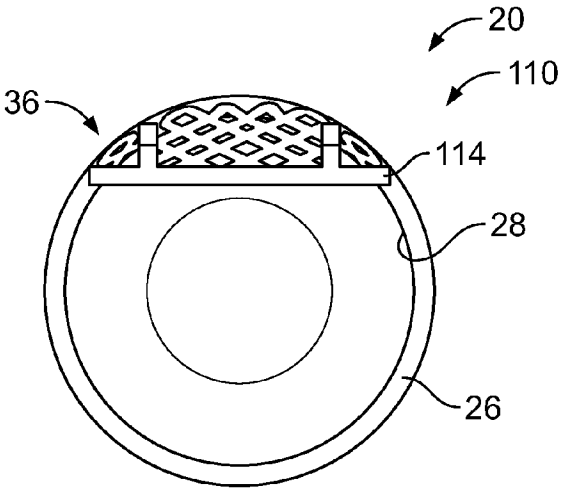
FIG. 5A is a top view of an alternative embodiment of a bowl having a soccer goal extending from the end of the bowl.
Figure 5C:
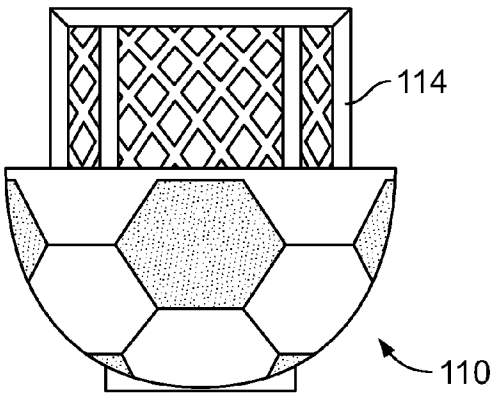
FIG. 5C is a front view of the bowl of FIG. 5A.
Figure 5E:
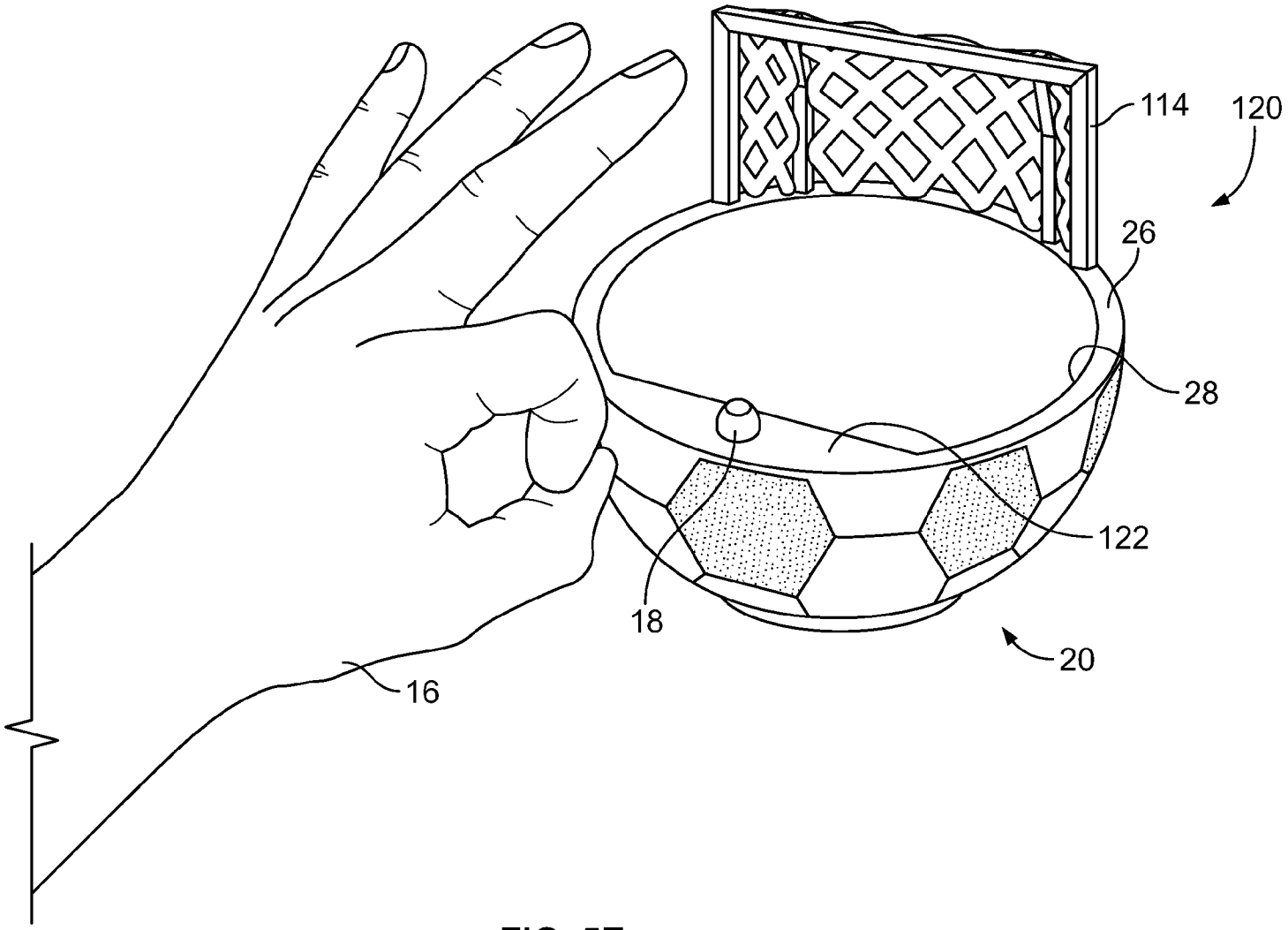
FIG. 5E is a perspective view of a bowl similar to that of FIG. 5A with a platform at the opposite side from the soccer goal.
Figure 7B:
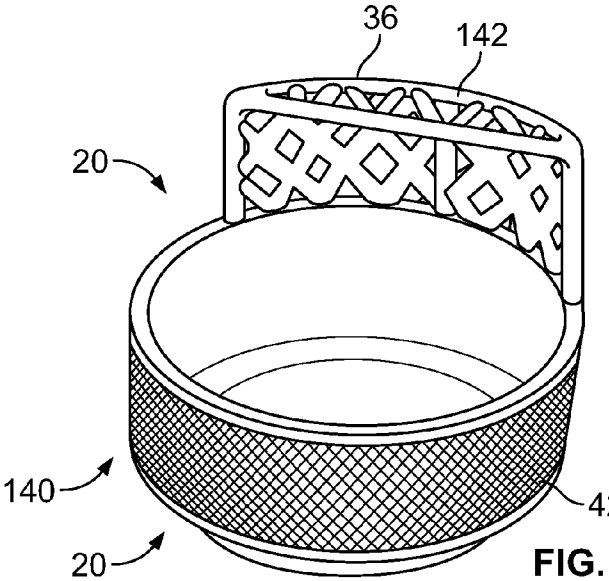
FIG. 7B is a perspective view of the mug of FIG. 7A.
Figure 7A:
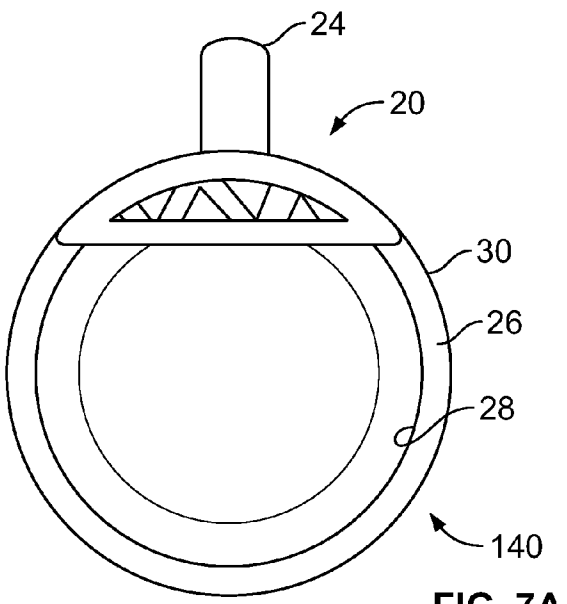
FIG. 7A is a top view of an alternative embodiment of a mug having a hockey goal extending from the end of the mug having a handle.
Figure 7D:
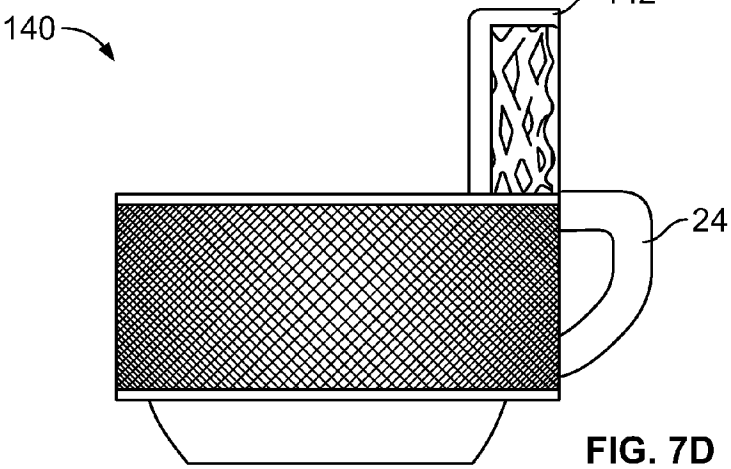
FIG. 7D is a side view of the mug of FIG. 7A.
Figure 7C:
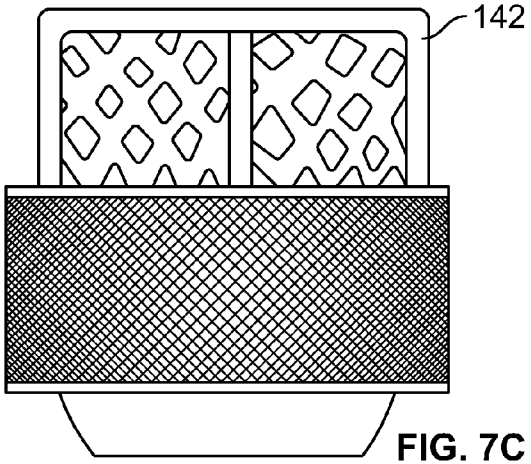
FIG. 7C is a front view of the mug of FIG. 7A.
Figure 7E:
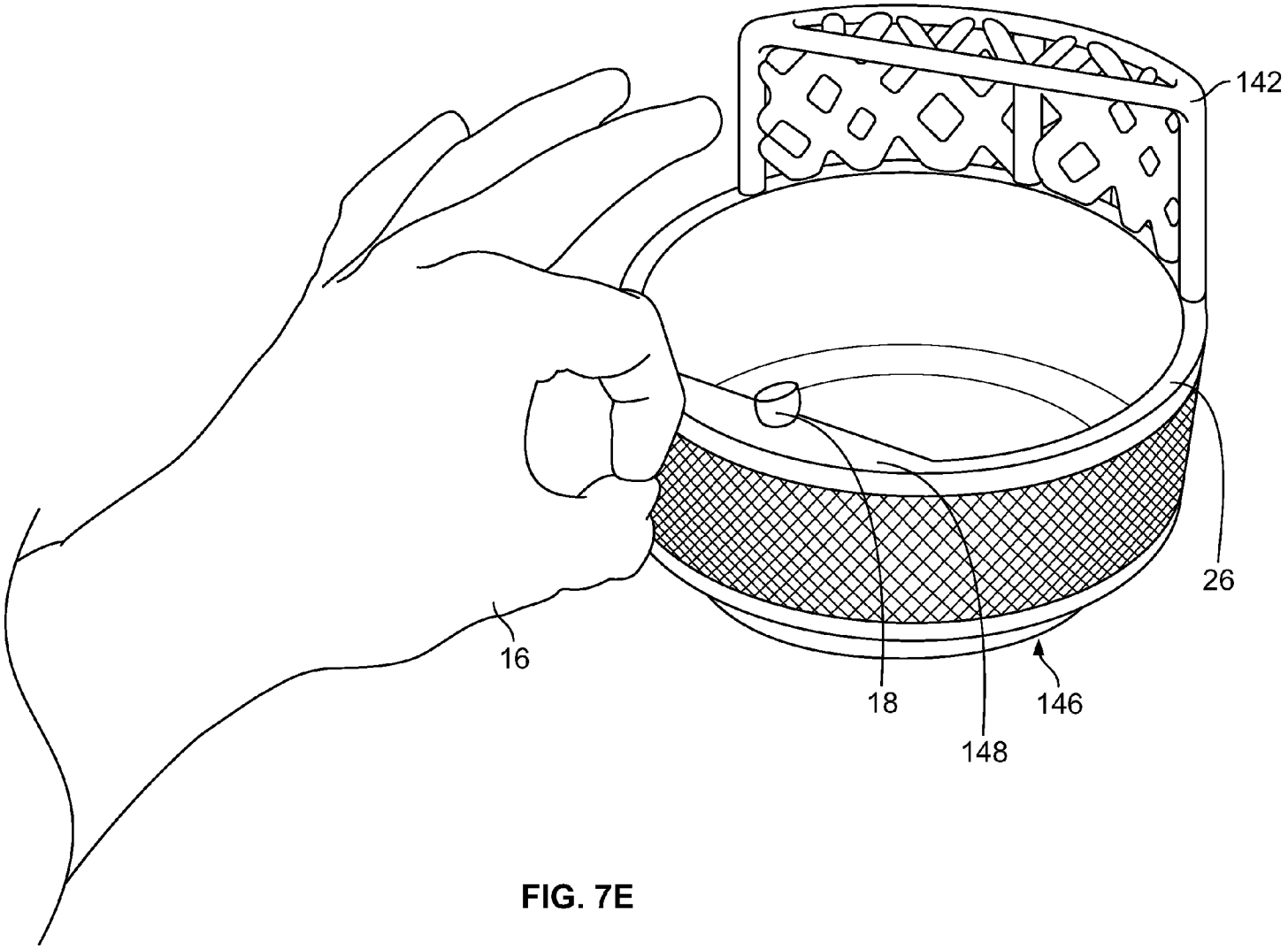
FIG. 7E is a perspective view of a mug similar to that of FIG. 7A with a platform at the opposite side from the hockey goal.
Figure 8A:
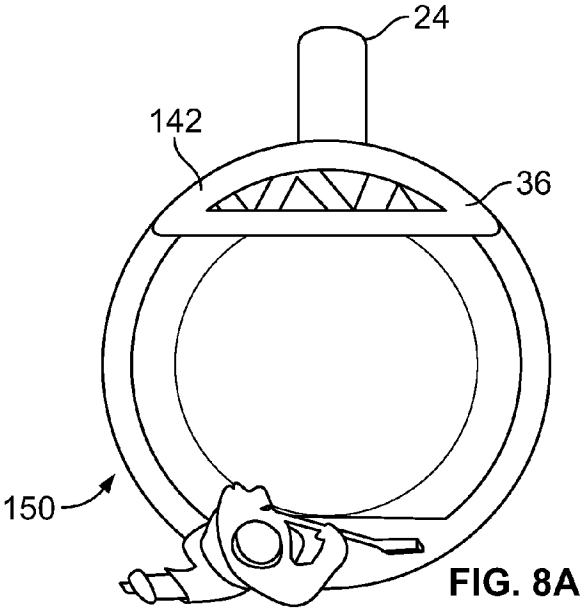
FIG. 8A is a top view of a mug having a hockey goal extending from the lip of the mug near the handle and a platform with a rotatable hockey figurine on the opposite side from the handle.
Figure 8B:
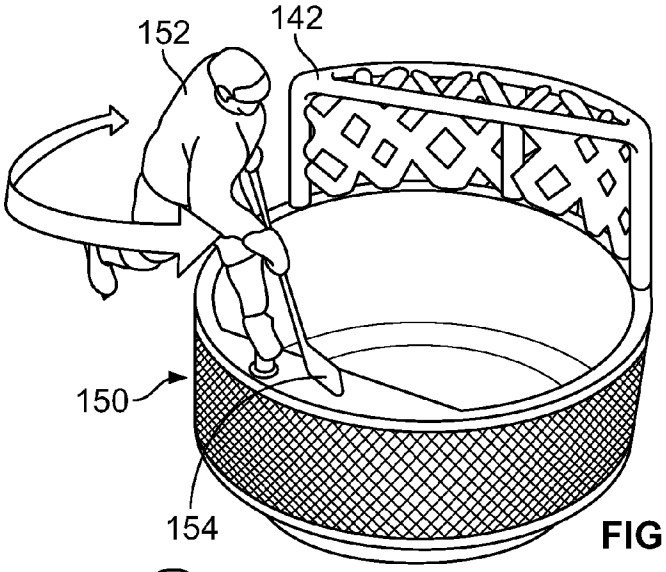
FIG. 8B is a perspective view of the mug of FIG. 8A.
Figure 8C:
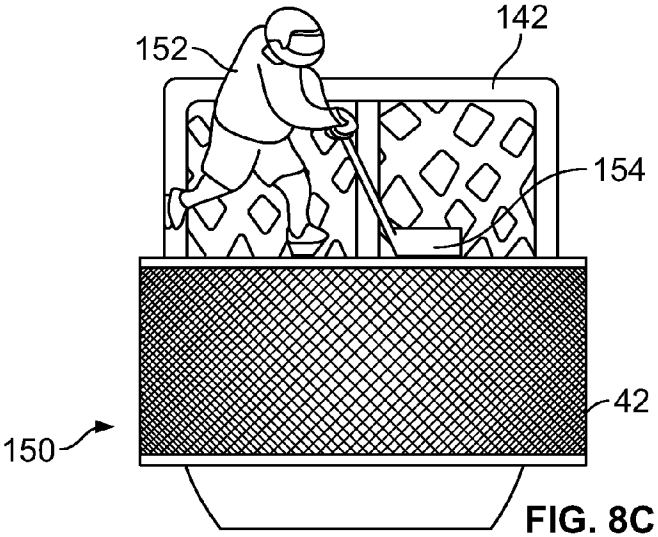
FIG. 8C is a front view of the mug of FIG. 8A.
Figure 8D:
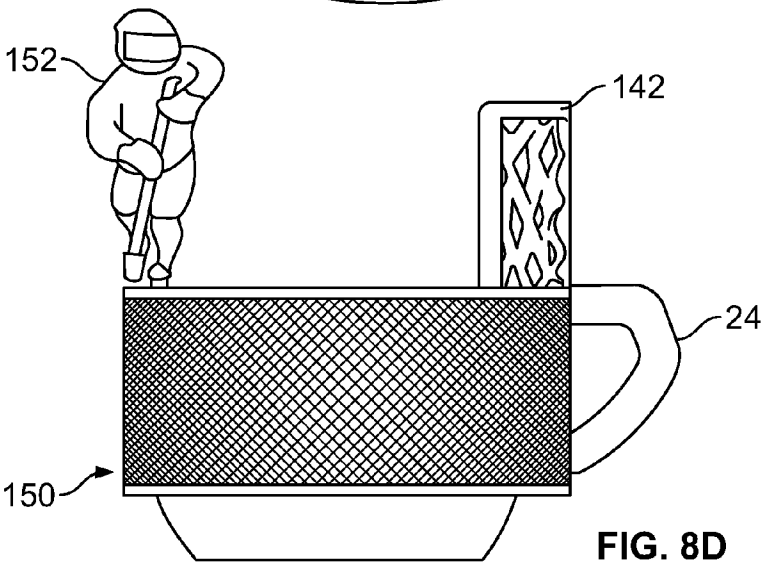
FIG. 8D is a side view of the mug of FIG. 8A.

While the flicking of a food product 18 is described with respect to the embodiment shown in FIG. 3E with the inclined platform 92, it is recognized that the platform 54, which is not inclined, in FIGS. 3A-3D can also be used to flick a food product 18; other embodiments such as shown in FIGS. 5E and 7E show flicking a food product 18 off a non-inclined platform 54.

In the embodiment shown, the netting is formed of the same material as the post; however it is possible that that net could be made of other materials such as food grade plastic, food grade nylon, glass. It is contemplated that it would be generally preferred in an embodiment that the material be dishwasher safe.

Referring to FIGS. 4A-4D, a top view, perspective view, a front view, and a side view of an alternative embodiment of a mug 100 having a football figurine 102 extending from the end of the mug 100 having a handle 24 and a platform 54 on the opposite end that in part forms the cross-section of a football is shown. The vessel 20 has a figurine; the football figurine 102 can be used as the target as shown in FIGS. 4A-D, where a football figurine 102 with a pair of extended hands 104 being the designated target to try and throw or flick items such as a food product 18 towards the extended hands 104.

In an embodiment, the platform 54 has a recess or dimple 106. The recess 106 defines a position for holding the food product 18. The recess 106 is slight so it limits movement of the food product 18 when engaged by the user 16.

It is recognized that the platform 54 could be an inclined platform 92 such as shown in FIG. 3E.

Referring to FIG. 5A, a top view of a vessel 20 is shown. The vessel 20 is a bowl 110. The bowl 110 has a lip or rim 26 between an interior surface 28 and the exterior surface 30. While size is not claimed, the volume defined by the interior surface 28 is generally larger in a bowl than in a mug. The bowl 110 has an extension indicative 36, which in this embodiment is a soccer goal 114, which is formed integral with the bowl 110 and extends upward from the lip 26 of the bowl 110. The top of the soccer goal 114 over hangs a portion of the interior of the bowl 110.

Referring to FIG. 5B, a perspective view of the bowl 110 is shown. The extension indicative 36, the soccer goal 114, extends upward from the lip 26. The bowl 110 in addition to the soccer goal 114, has a design 42 including texture and coloring to look like a soccer ball. It is recognized that the coloring of the bowl 110 could be painted to represent a team color.

Referring to FIG. 5C, a front view of the bowl 110 of FIG. 5A is shown. A side view of the bowl 110 of FIG. 5A is shown in FIG. 5D. The lip or rim 26 has a uniform thickness around the bowl 110 in the embodiment shown.

Referring to FIG. 5E, a perspective view of a bowl 120 similar to that of the bowl 110 in FIGS. 5A-5D with a platform 122 which is at the opposite end (apex) from the soccer goal 114 is shown. The platform 122 differs in thickness with respect to the rest of the lip or rim 26 of the bowl 120. The platform 122 allows a user 16 to flick a food product 18, such as mini-marshmallows, toward the soccer goal 114 that also includes netting for catching the flicked items.

Figure 6A:
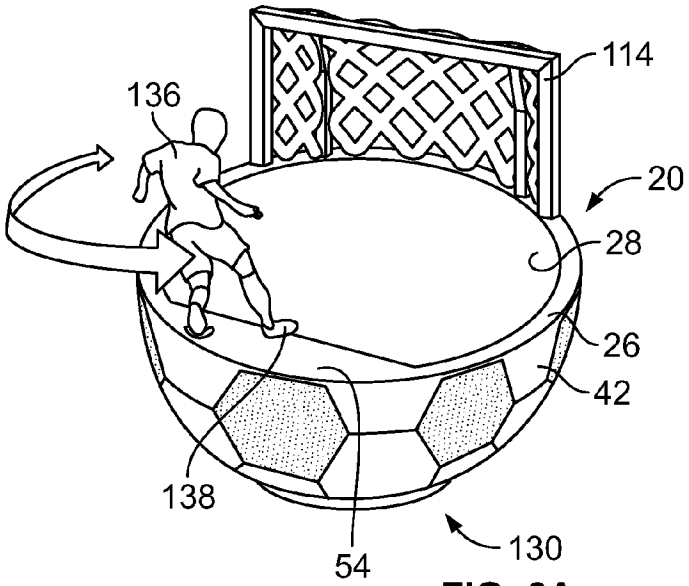
FIG. 6A is a perspective view of an alternative embodiment of a mug having a soccer goal extending from the lip of the end of the mug having a handle and a platform on the opposite end that has a rotatable soccer figurine.
Figure 6B:
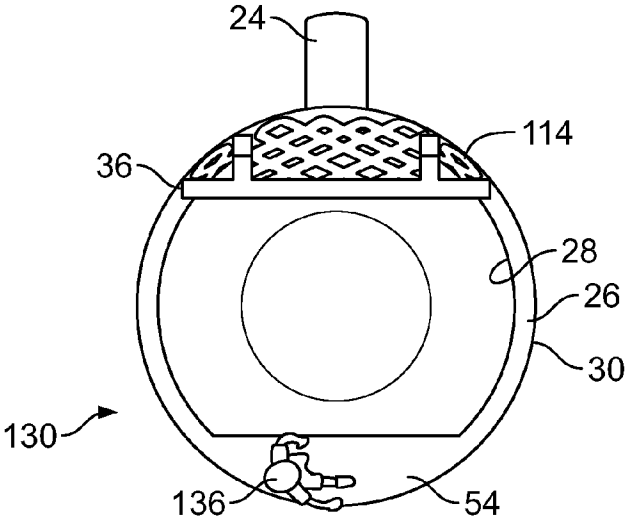
FIG. 6B is a top view of the mug of FIG. 6A.
Figure 6C:
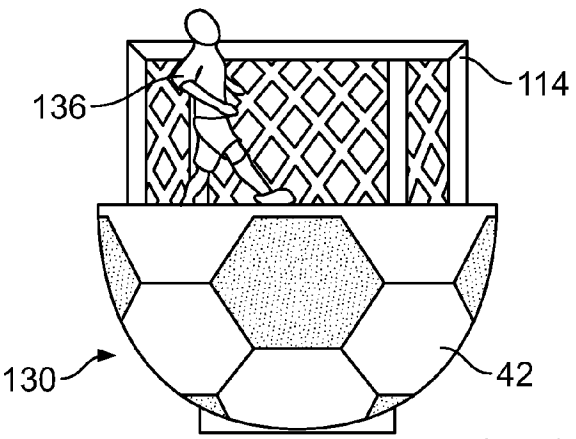
FIG. 6C is a front view of the mug of FIG. 6A.
Figure 6D:
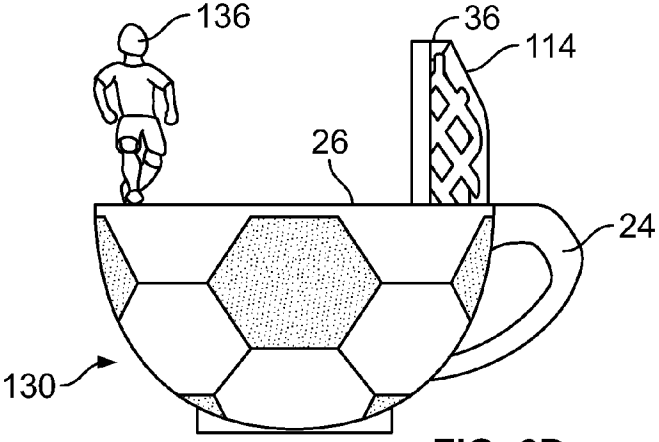
FIG. 6D is a side view of the mug of FIG. 6A.

Referring to FIG. 6A, a perspective view of an alternative embodiment of a mug 130 having a soccer goal 114 extending from the lip 26 of the end of the mug 130 having a handle 24, as seen FIGS. 6B and 6D, and a platform 54 on the opposite end that has a rotatable soccer figurine 136 is shown. The mug 130 has an extension indicative 36 which in this embodiment is the soccer goal 114 extending from the lip 26 of the mug 130 near the handle 24. The platform 54 of the mug 130 is a larger area of the lip or rim 26 on the side opposite from the handle 24.

The mug 130 has similarities to the mug 50 of FIGS. 2A-2D that has the baseball figurine 56 on the platform 54. While not shown in FIGS. 6A-6D, the rotatable soccer figurine 136 has a shaft that extends from the figurine 136. In an embodiment, the vessel 20 has a spring that returns or swings the figurine 136 back towards the launch position once rotated. In the rotatable soccer figurine 136, the player's right foot 138 is capable of swinging to "kick" an item, food product 18, off the platform 54 towards the soccer goal 114 that extend upwards from the mug 22 on the opposite side.

FIG. 6B show a top view of the mug 130 of FIG. 6A. A front view of the mug 130 of FIG. 6A is shown in FIG. 6C. FIG. 6D is a side view of the mug 130 of FIG. 6A and shows the handle 24. In addition to the soccer goal 114, the mug 130 has a design 42 which in this embodiment is similar to that described above with respect to FIGS. 5A-5E.

It is recognized that embodiments can vary. For example, the vessel 20 of the embodiment with the rotatable soccer figurine could be a bowl and the vessel 20 of the embodiment shown in FIGS. 5A-5E could be a mug.

It is recognized that the vessel 20 can be formed to reflect various sports and/or activities. Referring to FIGS. 7A-7D, an alternative embodiment of a mug 140 has a hockey goal 142 extending from the end of the mug 140 having a handle 24 is shown. The exterior surface 30 has a design that resembles a hockey puck. FIG. 7E shows an alternative embodiment of a mug 146 having a platform 148 opposite the hockey goal 142. The design 42 of the vessel 20 such as the mugs 140 and 148 can be modified based on the desire of the designer. For example, the mugs 140 and 148 can have a knurled or a smooth surface.

Referring to FIGS. 8A-8D, an alternative embodiment of a mug 150 with a rotatable hockey figurine 152 on a platform 148 opposite of the hockey goal 142 is shown. Similar to the embodiment of FIGS. 6A-6D, the figurine rotates. The rotatable hockey figurine 152 has a hockey stick 154 which engages the food product 18.

Figure 9A:
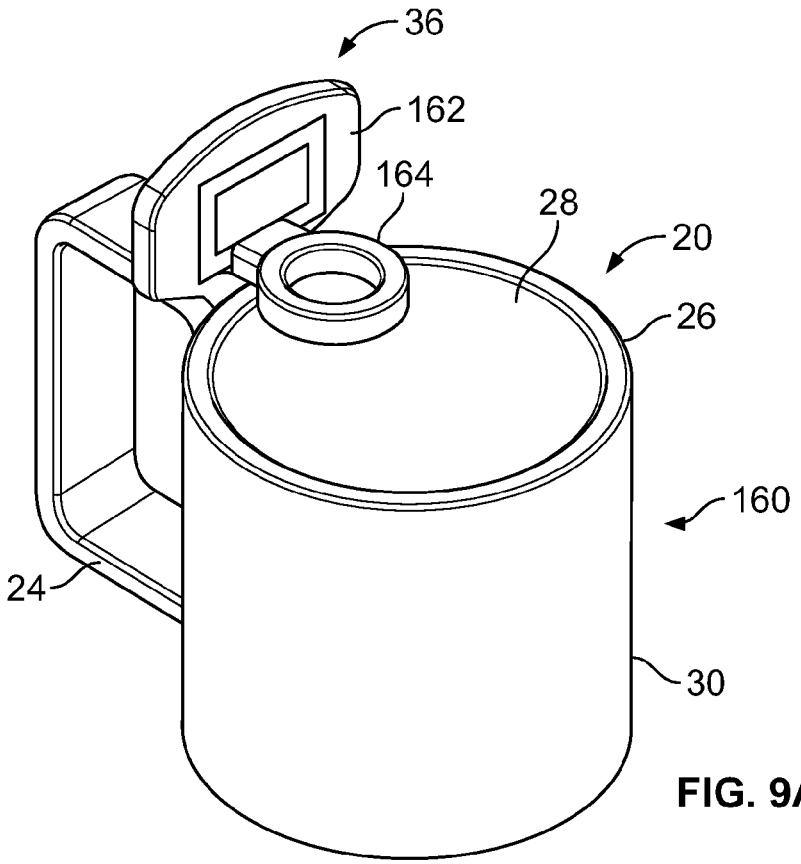
FIG. 9A is a perspective view of an a mug having a basketball backboard and a rim extending from the lip of the mug having a handle.

Referring to FIG. 9A, a perspective view of a vessel 20, a mug 160 is shown. In contrast to most of the embodiments shown, the mug 160 has more of a cylindrical shape than a dome shape. The mug 160 has the lip or rim 26 between the interior surface 28 and the exterior surface 30. The mug 160 has an extension indicative 36, which in this embodiment is a basketball backboard 162 and a basketball rim 164, which is formed integral with the mug 162 and extends upward from the lip 26 of the mug 22 near the handle 24.

Figure 9B:
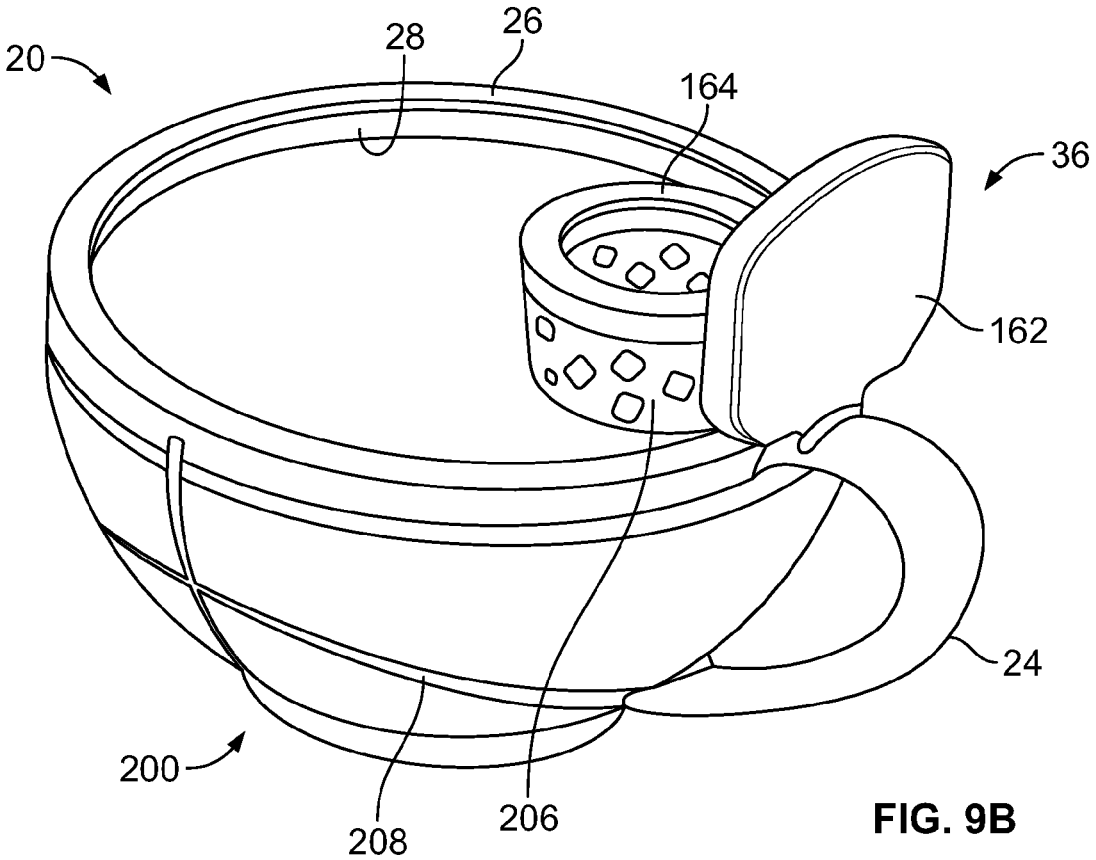
FIG. 9B is a perspective view of an alternative embodiment of a mug having a basketball backboard and net extending from the lip of the mug having a handle.

Referring to FIG. 9B, a perspective view of an alternative embodiment of a mug 200 having a basketball backboard 162 and a net 206 extending from the lip 26 of the mug 200 is shown. The mug 200 has more of a dome shape than the mug 160 shown in FIG. 9A. The mug 200 has an extension indicative 36, which in this embodiment is the basketball backboard 162, the rim 164, and the net 206. The extension indicative 36 is formed integral with the mug 200 and extends upward from the handle 24 and lip 26 over the mug 200 such that the net 206 is entirely over the interior of the mug 200.

The mug 200 in addition to the extension indicative 36 has a design 42 which includes the ribs 208. In an embodiment, the exterior surface 30 is an orange color with the ribs 208 being a black color.

Figure 10D:
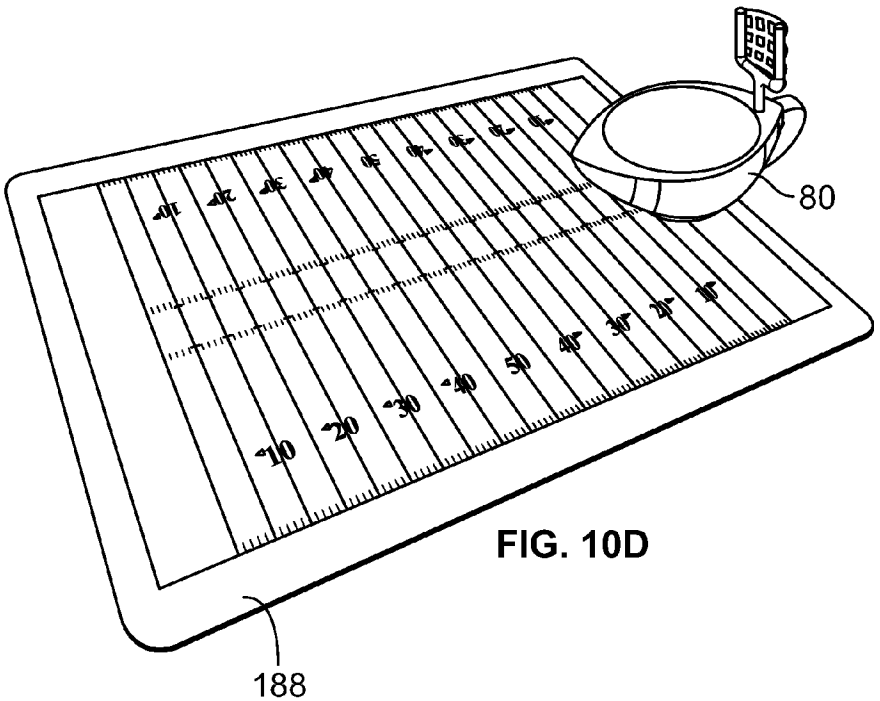
FIG. 10D is a perspective view of a football field placemat with a mug.
Figure 10A:
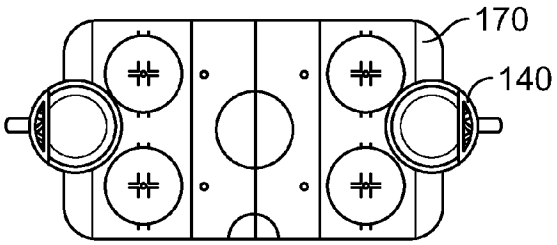
FIG. 10A is a top view of a hockey rink placemat with a pair of mugs.
Figure 10B:
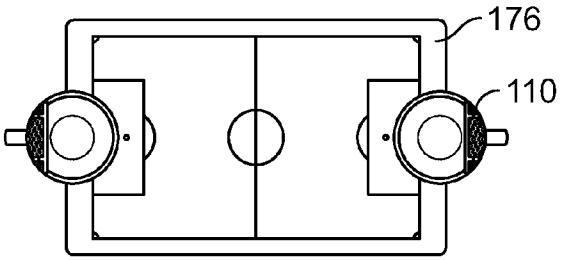
FIG. 10B is a top view of a soccer field placemat with a pair of mugs.

Referring to FIGS. 10A-10E, a play system 12 has a placemat 166 and at least one vessel 20. FIG. 10A shows a hockey placemat 170. FIG. 10B shows a soccer placemat 176. The play on the play system 12 could be two players alternating shooting or throwing the food product 18 towards the opposite goal. For example the mug 140 or the bowl 110 can be placed at opposite ends of the mat where the goal would be located in the hockey rink or soccer field. A counter 196*a* and 196*b* such as shown in FIGS. 11A and 11B can used to count goals.

Figure 10C:
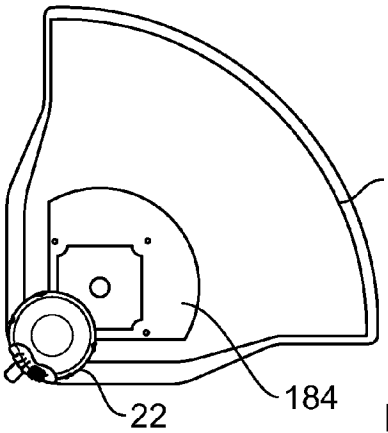
FIG. 10C is a top view of a baseball field placemat with a mug.
Figure 11A:
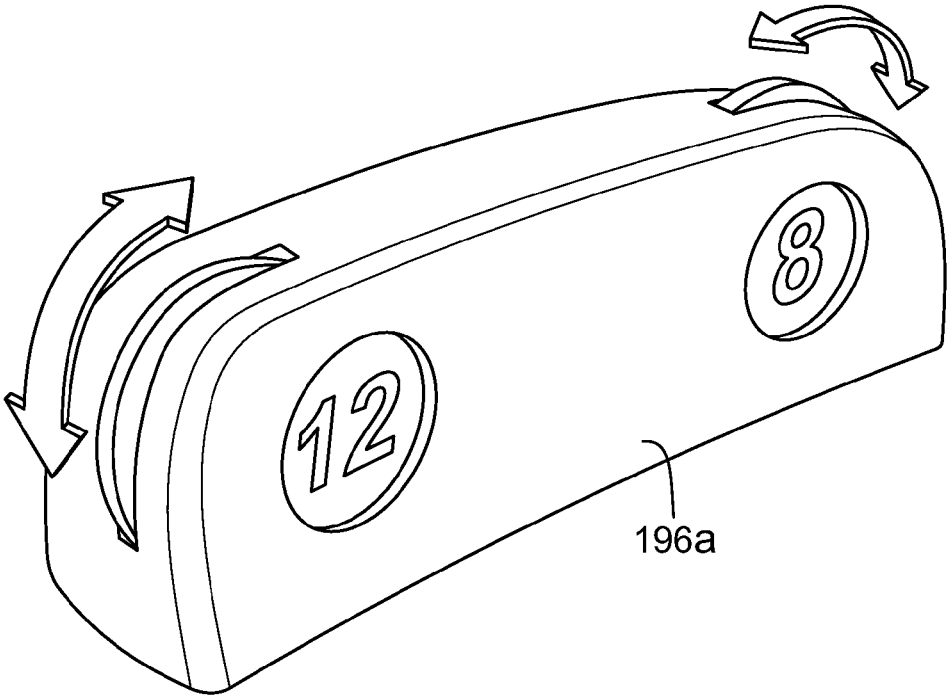
FIGS. 11A-11B illustrate various counters that may be incorporated into the systems shown in FIGS. 10A-10D.
Figure 11B:
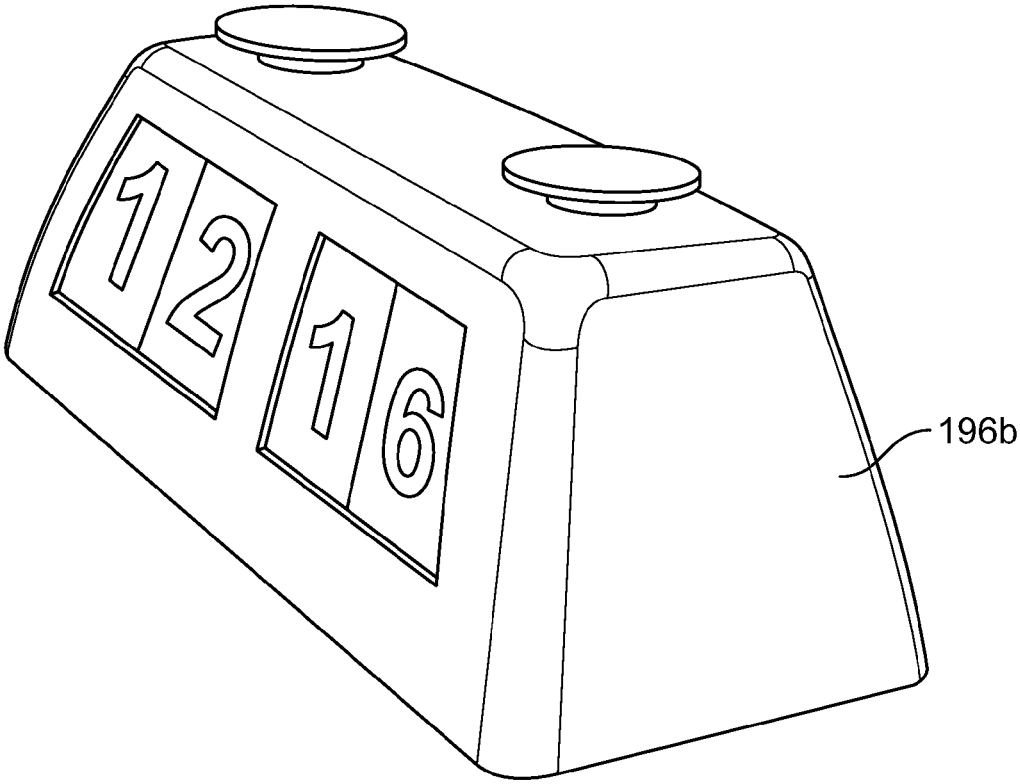

Referring to FIG. 10C, a top view of a baseball field placemat 182 with a mug is shown. A user or a plurality of users could take turns hitting food product 18 towards the baseball outfield wall 52 on a mug such as shown in FIG. 2B. Dependent on the category 62 that the food product 18 hits, a token or another food product 18 can be moved around a baseball diamond 184 on the baseball field placemat 184. A counter 196*a* and 196*b* such as shown in FIGS. 11A and 11B can be used to count runs.

Figure 10E:
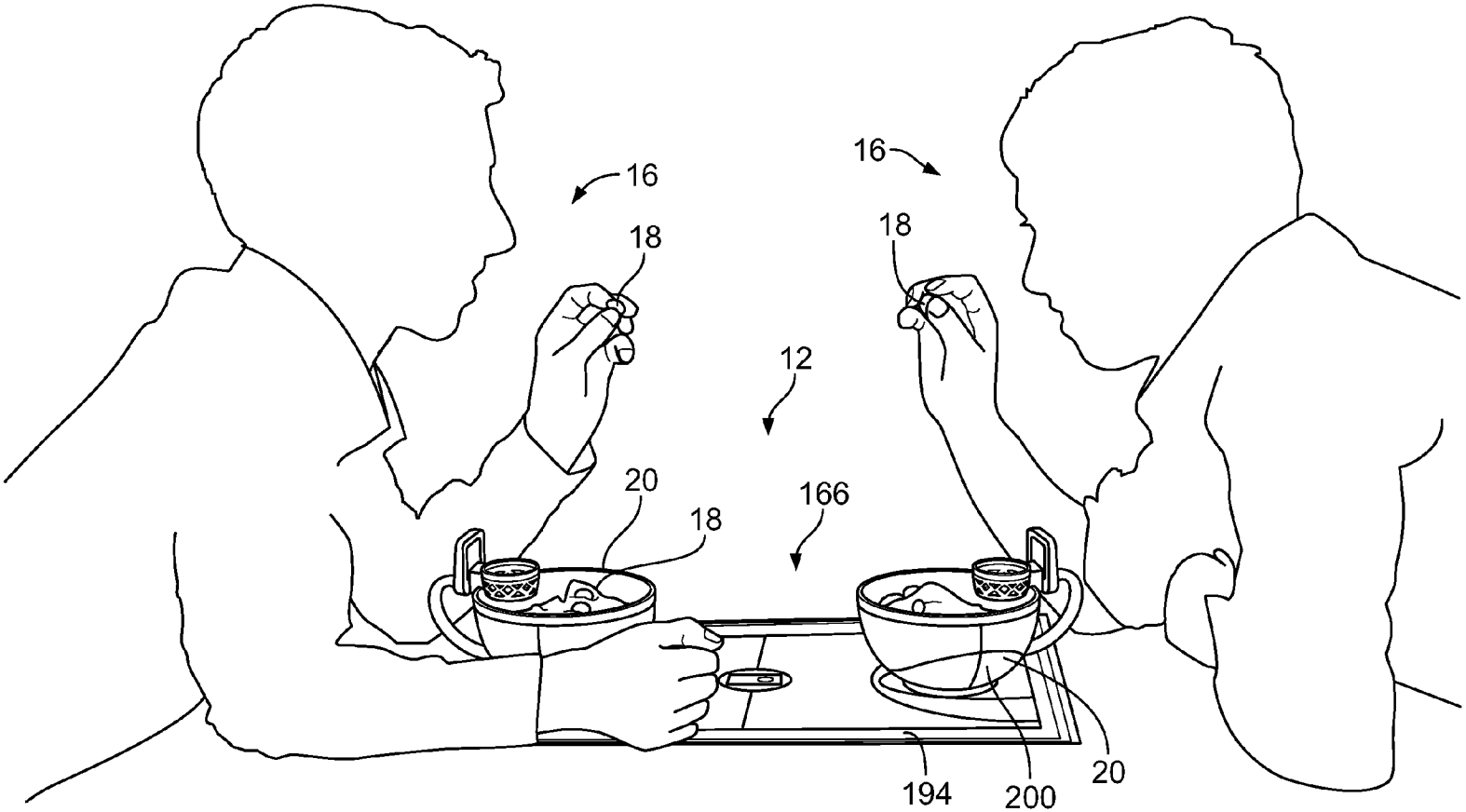
FIG. 10E is a perspective view of a basketball court placemat with a pair of mugs.

Referring to FIG. 10E, a perspective view of a basketball court placemat 194 with a pair of mugs 200 is shown. The placemat 166 in this embodiment is a basketball court placemat 194. The FIG. shows a pair of users 16 throwing food product 18 at the vessels 20, basketball mugs 200 at the other end of the court.

Each of the mugs or bowls illustrated and described above may be configured to be incorporated with placemats that are illustrative of playing fields as shown in FIGS. 10A-10E and point counters (FIGS. 11A and 11B) may also be included in these setups and placed on the mats or connected to the mugs themselves. It is recognized that placemats for other activities such as basketball can be incorporated.

While several embodiments have been described herein that are exemplary of the present invention, one skilled in the art will recognize additional embodiments within the spirit and scope of the invention. Modification and variation can be made to the disclosed embodiments without departing from the scope of the disclosure. Those skilled in the art will appreciate that the applications of the embodiments disclosed herein are varied. Accordingly, additions and modifications can be made without departing from the principles of the disclosure. In this regard, it is intended that such changes would still fall within the scope of the disclosure. Therefore, this disclosure is not limited to particular embodiments, but is intended to cover modifications within the spirit and scope of the disclosure.

It is recognized that additional embodiments with platforms and sports equipment extending on the opposite end of the mug are contemplated. Platforms may vary in depth, incline, shape, having tees, or including rotatable figurines. For example other sports and/or activities such as golf, tennis, lacrosse, volleyball, and kick ball are contemplated.

It is recognized the handle size and curvature will be determined at the designer's discretion, to meet the design constraints above and still be functional.

It is recognized in some embodiments, the mug similar to shown may include an open top rim of 5 inch outside diameter and have capacity ranging from 16 fl. oz. up to 20 fl. oz., at the designer's discretion of what looks best for the entire mug.

It is recognized that the mug can be half-ball shaped, interrupted at the base by a cylindrical rim allowing a stable mug, the base rim diameter at designer's discretion. It is recognized that the cup top rim height up from table will depend on the handle being practical, and the mug capacity, at the designer's discretion.

It is recognized that the vessel, the bowl or container may be more rectangular in shape with extending goals with nets on either side. In yet another embodiment, a hoop or ring with ramp or slide placed beneath the hoop or ring extends into the open portion of the container.

It is recognized that in shorter or less fluid capacity mugs, the hoop or rings extending over the open portion of the container may act as a stand to hold a straw upright and prevent it from falling over. This is especially useful with mugs, bowls, or other containers with shallow cavities.

What is claimed is:

1. A vessel comprising:

a drinking container configured to hold a beverage having an open end and having a lip forming a perimeter edge about the open end, the lip having a lip portion including a platform which extends radially inwardly from an upper outer perimeter edge of the lip portion, wherein the platform is capable of supporting a piece of food; and an extension projecting upward from the lip, wherein the extension is opposite the platform, and wherein the extension is indicative of a sporting equipment, which includes a net being indicative of soccer or hockey.

2. The vessel of claim 1, further comprising a handle portion extending from a sidewall of the container, and the container defining a mug.

3. The vessel of claim 1, wherein the vessel is a bowl.

4. The vessel of claim 3, wherein lip of the container has a shape indicative of sporting equipment.

5. The vessel of claim 4, wherein the shape is elliptical.

6. The vessel of claim 4, wherein the shape is circular.

7. A play system comprising:

at least one vessel including:

a drinking container configured to hold a beverage having an open end and having a lip forming a perimeter edge about the open end, the lip having a lip portion including a platform which extends radially inwardly from an upper outer perimeter edge of the lip portion, wherein the platform is capable of supporting a piece of food; and an extension indicative of a sporting equipment extending from the lip, the extension forming a target, the target being positioned above the lip about the open end of the container;

a figurine projecting upward from the platform of the lip opposite the extension and adapted to move a food product towards the extension, wherein the extension indicative of a sporting equipment includes a net being indicative of soccer or hockey, wherein the net extends upwardly from the lip.

8. The play system of claim 7, wherein the figurine further comprises a return mechanism for rotating the figurine from a cocked position to a launch position.

9. The play system of claim 8, wherein the return mechanism has a shaft extending from the figurine and a spring for biasing the figurine towards the launch position.

10. The A play system of claim 9, wherein the vessel further comprises a handle portion extending from a sidewall of the container, the container being defined as a mug.

11. A mug comprising:

a drinking container configured to hold a beverage having an open end and having a launch platform, the launch platform extending radially inwardly from an upper perimeter edge of the container, and wherein the launch platform is coplanar with the upper perimeter edge;

a handle portion extending from a sidewall of the container;

an extension indicative of sporting equipment that includes a net being indicative of soccer or hockey, wherein the net extends upwardly from an arcuate portion of the upper perimeter edge; and wherein an exterior surface of the container is provided with a textured design indicative of sporting equipment.

* * * * *